United States Patent [19]

Mallaghan

[11] 4,381,235

[45] Apr. 26, 1983

[54] SCREENING APPARATUS

[75] Inventor: Lee Mallaghan, Maynooth, Ireland

[73] Assignee: Powerscreen Limited, Maynooth, Ireland

[21] Appl. No.: 208,777

[22] Filed: Nov. 20, 1980

[51] Int. Cl.[3] ..... B07B 1/12

[52] U.S. Cl. ..... 209/400; 209/404

[58] Field of Search ..... 209/660, 674, 676, 677, 209/679, 309, 325, 322, 392, 400, 404, 413, 659

[56] References Cited

U.S. PATENT DOCUMENTS

| | | | |
|---|---|---|---|
| 436,615 | 9/1890 | Stehle | 209/400 |
| 812,333 | 2/1906 | Edstrom | 209/400 |
| 912,481 | 2/1909 | Melish | 209/400 X |
| 1,424,451 | 8/1922 | Crandall | 209/413 |
| 1,458,299 | 6/1923 | Jacquelin | 209/400 |
| 2,810,481 | 10/1957 | Lofquist et al. | 209/400 X |
| 2,983,381 | 5/1961 | Ball | 209/400 |
| 3,106,524 | 10/1963 | Wolfe et al. | 209/400 X |
| 4,162,968 | 7/1979 | Gellhaus | 209/400 |

*Primary Examiner*—Allen N. Knowles
*Attorney, Agent, or Firm*—William R. Hinds

[57] ABSTRACT

A screening apparatus comprising a rectangular screening frame and a multiplicity of parallel wires which are tensioned across the screening frame has a plurality of support bars with guide slots in order to support additionally each wire. The support bars are axially rotatably and interchangeably secured to the screening frame thus allowing to use the same screening frame for different string assemblies with different distances between the wires.

If guide slots for different wire spacings are provided at different sides of a support bar, the same frame and the same support bars can be used for different string assemblies.

The arrangement according to the invention allows an easy and rapid change of string assemblies on the same screening frame.

11 Claims, 4 Drawing Figures

SCREENING APPARATUS

The invention relates to a screening apparatus comprising a rectangular screening frame and a multiplicity of parallel wires which are tensioned across the screening frame and which are fixed to the screening frame and tensioned by two oppositely disposed tensioning means, and a plurality of support bars which extend transversely with respect to the wires and which are secured to the side members of the screening frame and which have guide slots for receiving the individual wires.

Because of their characteristic arrangement of the parallel wires, such screening apparatus are also referred to as harp screens. In practice, harp screens of this kind are used primarily for screening out heavy bulk materials such as for example sand, earth, ore, etc. To perform the screening operation, the screening frame is normally set in an inclined position so that the bulk material is fed on to the screen surface at a given angle. In addition, the entire screen is displaced with a vibrating or oscillating motion, by a vibrator device. When this is done, according to the desired classification of the bulk material, individual components pass through the spaces between the tensioned wires, while other components slide on the wires down to the lower end of the inclined frame. In order to ensure that the individual wires cannot open an excessive space between them, by virtue of the resiliency of their material, individual support bars which are provided with guide slots for receiving the screening wires are mounted in the transverse members of the frame, at predetermined distances apart. Thus, each wire is additionally supported and held at a plurality of positions, between the oppositely disposed retaining means.

In the previously known screening apparatus, the wires were each tensioned between the retaining means individually or in pairs, and set to the correct tension, similarly as in the case of string instruments, by means of individual tensioning means. The distance between the individual wires was thus predetermined by the distance between the individual tensioning means, and could not be altered. The distance between the guide slots on the support bar was also fixed. If finer or coarser stringing of the screening frame was desired, it was necessary to string a fresh screening frame in which the retaining means were adapted to the desired requirements. In addition, the support bars were welded into the frame, which further increased the difficulty of replacing the bars.

As an additional further development of the conventional stringing methods, it is possible for a prefabricated string assembly with fixed distances between its wires to be fitted into the screening frame. For these prefabricated string assemblies, use is made of a retaining means wherein the end portions of the string assembly are clamped into a U-shaped recess by means of a pressing bar, and thereby fixed in position. The speed of the stringing operation can be considerably increased in this manner. Furthermore, the prefabricated string assemblies enjoy the advantage that one and the same retaining means can be used for different string assemblies with different wire spacings, as the wires no longer have to be tensioned individually. Nonetheless, it is not possible to use the same screening frame for the string assembly, as the distances between the guide slots on the support bars did not coincide with the distances between the individual wires of the string assembly. In addition, the rigid construction of the screening apparatus suffered from the disadvantage that the entire screen had to be replaced simply when the support bars were worn away on one side.

It is therefore the problem of the invention to overcome the disadvantages of the known art and in particular to provide a screening apparatus in which the same screening frame may be rapidly and easily provided with different string assemblies, on the building brick principle.

According to the invention, this problem is solved in that the support bars are axially rotatably and/or interchangeably secured to the screening frame by means of releasable fixing means.

The apparatus according to the invention makes it possible for the string assembly of a screening frame to be replaced by another string assembly in which the distances between the wires are different. As all prefabricated string assemblies can be stretched into place with the same retaining means, it will be seen that it is only necessary for this purpose for the support bars to be replaced so that the distances between the guide slots are always adapted to the respective distances between the wires of the string assembly.

As the support bars are subjected virtually without interruption to the impact of bulk material, they are exposed to a particular degree of wear. It has therefore been found particularly advantageous if, in accordance with a further embodiment of the invention, the guide slots in the support bars are provided at at least two sides of the bars. As only the respective surface of a support bar which is directly exposed to the bulk material is worn away at a time, in this way the bar can be used a number of times by a simple rotary movement until the bar is completely worn out and must be replaced.

If guide slots for different wire spacings are provided at different sides of a support bar, the same frame can be used for different string assemblies, without the necessity for interchanging the support bars.

An embodiment of the invention is illustrated in the drawings and is described in greater detail hereinafter. In the drawings.

Figure 1:
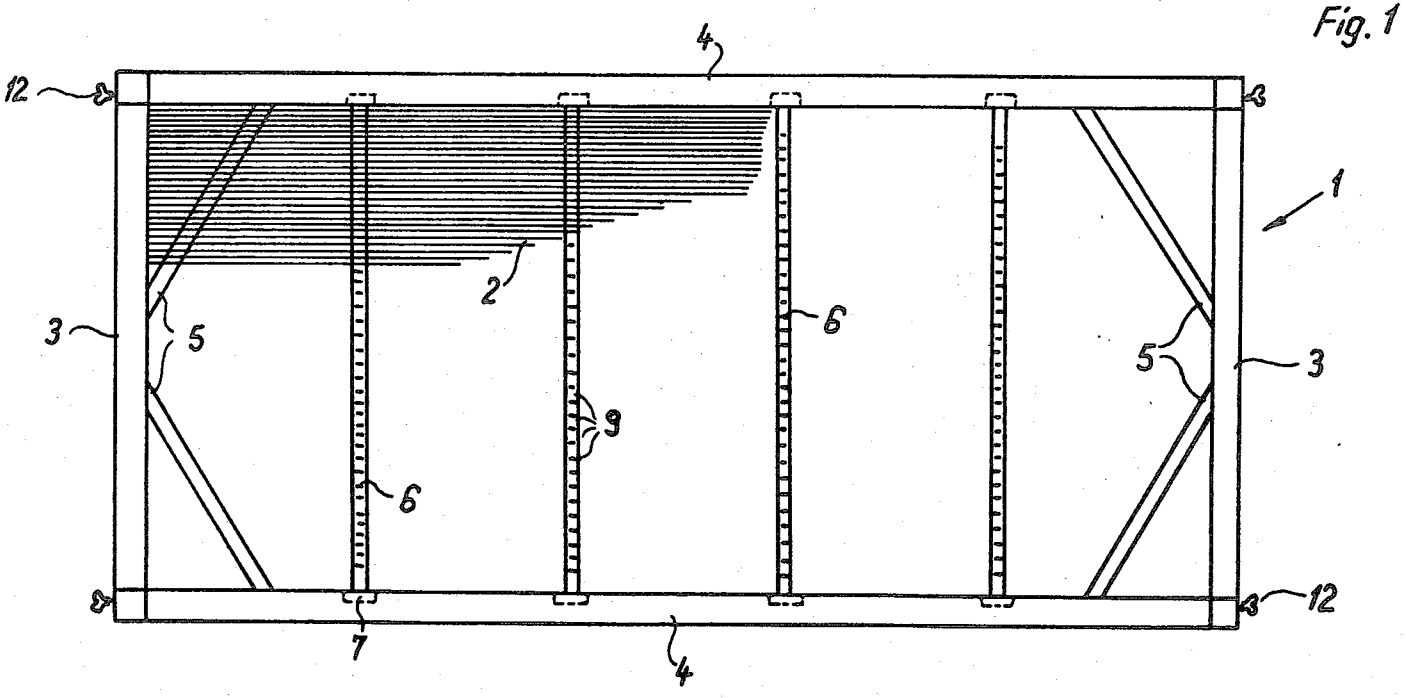
FIG. 1 shows a diagrammatic plan view of a screening apparatus.
Figure 2:
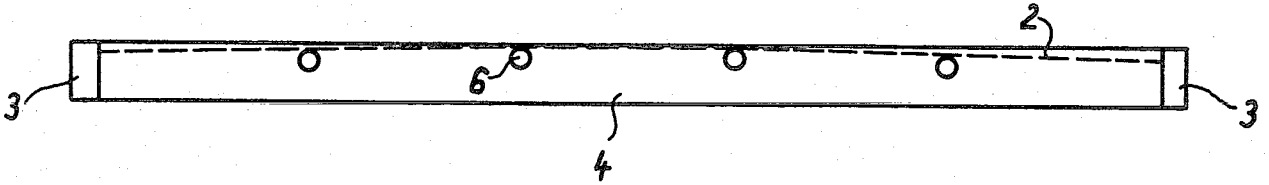
FIG. 2 shows a side view of the screening apparatus of FIG. 1.
Figure 3:
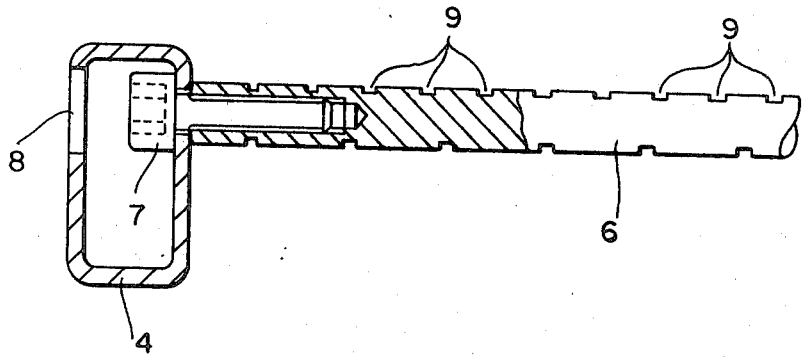
FIG. 3 shows a support bar on an enlarged scale and partly in cross-section.

As shown in FIG. 1, the screening apparatus substantially comprises two oppositely disposed retaining means 3 and the two transverse members 4 which together form the screening frame. The string assembly 2 is clamped in position and tensioned by the retaining means 3. In order to impart an additional degree of stability to the frame, at the relatively high tensional values, corner braces 5 are provided. The string assembly 2 is additionally fixed by the support bars 6. As shown in FIG. 2, the support bars 6 are arranged slightly displaced relative to each other, in order to keep the string assembly 2 absolutely taut. The guide slots 9 of the support bars 6 are arranged at a given spacing from each other, as shown in FIG. 3. The spacings between the guide slots correspond to the particular spacing desired between the wires of the string assembly. The guide slots may be provided on the support bar 6 either in the form of individual milled recesses or in the form of recesses extending around the bar. The transverse members 4 may be produced for example from a hollow member of rectangular section, to which the support bars 6 are secured by means of fixing bolts 7. So that the fixing bolts 7 can be mounted in the interior of the transverse members 4, the hollow member of rectangular section is provided at one side with a round opening 8 which is somewhat larger in diameter than the diameter of the bolt head.

As can also be seen from FIG. 3, guide slots 9 for different wire spacings may be provided for example at two opposite sides of a support bar.

Figure 4:
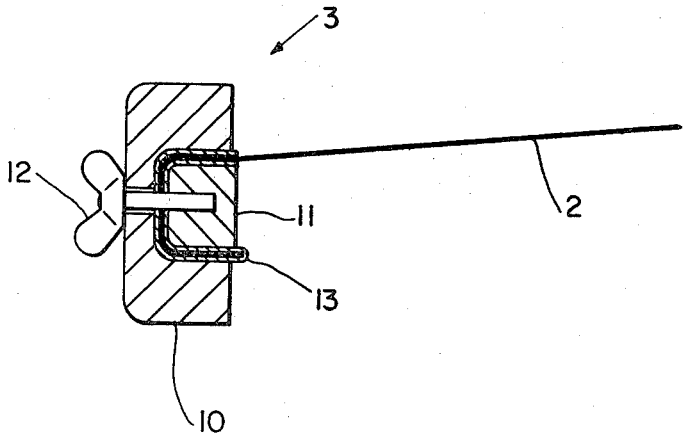
FIG. 4 shows a view in cross-section through a retaining means.

FIG. 4 shows a retaining means 3 for clamping and tightening the string assembly 2. The retaining means 3 comprises a beam member 10 having an approximately U-shaped recess. A pressing bar 11 can be inserted into the U-shaped recess and can be firmly pressed into the recess by means of a wing-headed bolt 12. The prefabricated string assemblies 2 are provided with a reinforced end portion 13 which is fitted with an approximately positive engagement into the U-shaped recess in the beam member 10. It will be seen that string assemblies with wires at completely different spacings can be secured to the frame, by a retaining means of this kind. This means that a different string assembly can be fitted to the same screening frame, in a short period. For this purpose it is only necessary for the support bars 6 to be removed by releasing the retaining bolts 7 and replaced by fresh support bars in which the spacings between the guide slots 9 correspond to the new string assembly. If the support bars are provided with a plurality of rows of guide slots for different wire spacings, the bars only have to be turned into their correct position. The new string assembly is subsequently secured to the screening frame in a very simple manner, by the retaining means 3.

I claim:

1. A screening apparatus comprising a rectangular screening frame, a multiplicity of parallel laterally spaced wires releasably fixed to and tensioned between two oppositely disposed frame ends so as to extend across the screening frame, a plurality of support bars extending between side members of the frame and transversely with respect to the wires, said support bars having spaced guide slots releasably receiving and guiding the individual tensioned wires but otherwise not connected with or contacting said wires, said wires contacting only part of the peripheral surfaces of said support bars, and releasable fixing means releasably securing said support bars to said screening frame so as to permit removal and replacement of one or more of said support bars without disassembling said screening frame.

2. A screening apparatus as claimed in claim 1 wherein said releasable fixing means are accessible and releasable from the outer sides of the side members of said screening frame.

3. Screening apparatus as claimed in claim 2 wherein said releasable fixing means comprise bolts passing through said side members and releasably secured to said support bars.

4. Screening apparatus as claimed in claim 1 wherein said support bars are laterally removable from said screening frame and said tensioned wires.

5. Screening apparatus as claimed in claim 1 wherein said support bars are rotatable about their longitudinal axes so as to bring different surface portions into engagement with said wires and into exposure to material fed onto the screen surface.

6. Screening apparatus as claimed in claim 5 wherein said guide slots in the support bars are provided at at least two peripherally spaced portions of the support bars such that the support bars can be rotated to move relatively worn slotted portions away from the wires and relatively unworn slotted portions into engagement with the wires.

7. Screening apparatus as claimed in claim 5 wherein guide slots for different wire spacings are disposed at peripherally spaced portions of the support bars.

8. A screening apparatus comprising a rectangular screening frame, a multiplicity of parallel laterally spaced wires fixed to and tensioned between two oppositely disposed tensioning means so as to extend across the screening frame, a plurality of support bars extending between side members of the frame and transversely with respect to the wires, said support bars having spaced guide slots releasably receiving and guiding the individual tensioned wires but otherwise not connected with said wires, said wires contacting only part of the peripheral surfaces of said support bars, and means mounting said support bars for rotational adjustment about their longitudinal axes so as to bring different surface portions thereof into engagement with said wires and into exposure to material fed onto the screen surface.

9. Screening apparatus as claimed in claim 8 wherein said guide slots in the support bars are provided at at least two peripherally spaced portions of the support bars such that the support bars can be rotated to move relatively worn slotted portions away from the wires and relatively unworn slotted portions into engagement with the wires.

10. Screening apparatus as claimed in claim 8 wherein guide slots for different wire spacings are disposed at peripherally spaced portions of the support bars.

11. Screening apparatus as claimed in claim 8 wherein said mounting means for adjustably rotatably mounting said support bars comprise releasable fixing means releasably securing said support bars to said screening frame so as to permit removal and/or replacement of one or more of said support bars without disassembling said screening frame.

* * * * *